US007621829B2

(12) United States Patent
Barkume

(10) Patent No.: US 7,621,829 B2
(45) Date of Patent: Nov. 24, 2009

(54) GOALIE TRAINING DEVICE

(76) Inventor: Alexander J Barkume, 20 Gateway La., Manorville, NY (US) 11949

( * ) Notice: Subject to any disclaimer, the term of this patent is extended or adjusted under 35 U.S.C. 154(b) by 308 days.

(21) Appl. No.: 11/837,591

(22) Filed: Aug. 13, 2007

(65) Prior Publication Data

US 2007/0275795 A1 Nov. 29, 2007

(51) Int. Cl.
*A63B 69/00* (2006.01)

(52) U.S. Cl. ..... 473/446

(58) Field of Classification Search ..... 473/446, 473/2, 43, 206, 513; 16/421; 294/171; 482/139
See application file for complete search history.

(56) References Cited

U.S. PATENT DOCUMENTS

| | | | | | |
|---|---|---|---|---|---|
| 2,122,025 | A * | 6/1938 | Crary | 294/171 |
| 2,547,343 | A * | 4/1951 | O'Loughlin | 294/171 |
| 2,984,486 | A * | 5/1961 | Jones | 473/568 |
| 4,072,311 | A | 2/1978 | Bertucci | |
| 4,487,412 | A * | 12/1984 | Meeko | 482/139 |
| 4,549,537 | A * | 10/1985 | Ender | 602/21 |
| 5,232,436 | A * | 8/1993 | Janevski | 602/22 |
| 5,947,915 | A * | 9/1999 | Thibodo, Jr. | 602/5 |
| 6,174,248 | B1 | 1/2001 | Lawlor et al. | |
| 6,328,666 | B1 | 12/2001 | Manory | |
| 6,500,079 | B1 | 12/2002 | Tucker, Sr. | |
| 6,887,170 | B2 | 5/2005 | Stauber et al. | |
| 2005/0027223 | A1 * | 2/2005 | Nguyen | 602/23 |

* cited by examiner

*Primary Examiner*—Gene Kim
*Assistant Examiner*—M Chambers
(74) *Attorney, Agent, or Firm*—Barkume & Associates, P.C.

(57) ABSTRACT

The present invention is a training device that is able to condition a hockey goalie in the proper placement of his hand and index finger for effectively controlling a hockey stick. The training device includes a strap adapted to be fitted around the top of a paddle of the goalie's hockey stick, and a finger channel vertically affixed to the strap and positioned for removable holding his index finger so that the index finger is substantially pointed down the paddle of the goalie hockey stick when he is holding the goalie hockey stick.

3 Claims, 4 Drawing Sheets

GOALIE TRAINING DEVICE

TECHNICAL FIELD

This invention relates to sports training devices, and in particular to a training device that attaches to a goalie's hockey stick.

BACKGROUND ART

Learning to play hockey requires the use of many physical skills. All hockey players must be able to control the hockey puck (or ball) while skating (or running). A goalie hockey player must control the puck, skate (often backwards), and stop the puck from being shot into the net. To stop the puck from being shot into the net, the goalie wears pads on his legs, protective padding on his body, gloves on his hands, and a helmet on his head. In order to effectively stop the puck, the goalie needs to learn to position himself correctly between the shooter and the net and he needs to learn how to make leg saves, glove saves, and stick saves. Each of these saves requires the goalie to learn physical maneuvers of different body parts that are typically not instinctive. The goalie must condition himself to perform these saves automatically because he will not have time to think about which physical maneuvers should be performed when the puck is being shot at him.

For the stick save, proper hand and finger placement is critical for stopping the puck from going into the net. The goalie stick is different from a regular hockey stick in a number of ways. The blade is larger and extends up the shaft of the stick for approximately two feet to form the paddle. The goalie holds the shaft of the hockey stick with one hand just above the paddle and extends his index finger of that hand down the paddle. This hand placement is important because the blade of the stick must lie on the ice at an angle that keeps the puck from rolling over the blade and into the net. The hand placement with the index finger extended down the paddle allows the goalie to stabilize the stick and have enough control of the stick to stop the puck rather than have the blade pushed back by the puck hitting it and then the puck rolling under the stick into the net. Additionally, the hand placement with the index finger extended down the paddle allows the goalie to more easily guide the puck away from the net and into the corner of the rink so as to minimize rebound shots in which the goalie may be out of position.

For novice goalies the hand placement above the paddle with the index fingers extended down the paddle is not easily mastered. It is more intuitive to wrap the index finger around the shaft of the hockey stick like the other fingers. In addition, the goalie's blocker covers the hand holding the stick so if the novice goalie is not extending his index finger down the paddle it is not easily detected by his coach and may therefore not be corrected. It is desirable to have a training device that teaches the proper hand position and reminds the novice goalie to extend his index finger down the paddle of his hockey stick. Hockey regulations require the training device to be removed for game situations, but if the novice goalie uses the training device regularly during practice the finger placement will become automatic even when the training device is removed from the hockey stick.

It is therefore an object of the present invention to provide a goalie training device that would hold the index finger in the proper position extended down the paddle of the goalie hockey stick.

It is a further object of the present invention to provide a goalie training device that is easily attached to and removed from the hockey stick.

DISCLOSURE OF THE INVENTION

The present invention is a training device that is able to condition a hockey goalie in the proper placement of his hand and index finger for effectively controlling a hockey puck (or ball). The training device includes a strap adapted to be fitted around the top of a paddle of the goalie's hockey stick, and a finger channel vertically affixed to the strap and positioned for cupping his index finger so that the index finger is substantially pointed down the paddle of the goalie hockey stick when he is holding the goalie hockey stick.

The strap may be tubular in shape and made from a stretch material allowing it to be pulled over the paddle of the goalie hockey stick and to be tightly fitted to the paddle of the goalie hockey stick to secure the correct location of the finger channel. Alternatively the strap may be substantially rectangular in shape with connectors on opposing ends of the strap allowing it to be tightly wrapped around the paddle of the goalie hockey stick and fastened to secure the correct location of the finger channel. The connectors may be VELCRO fasteners or any other fasteners.

The finger channel protrudes from the strap and is a sleeve that may be close-ended, open-ended, or u-shaped. The close-ended finger channel looks like a thimble, while the open-ended finger channel looks like a small plastic tube. The preferred embodiment is a u-shaped finger channel that looks like a tube with the top cut off. In this embodiment the user is able to easily remove his finger from the device when he needs to adjust his hand position for a poke check.

BEST MODE FOR CARRYING OUT THE INVENTION

Figure 1A:
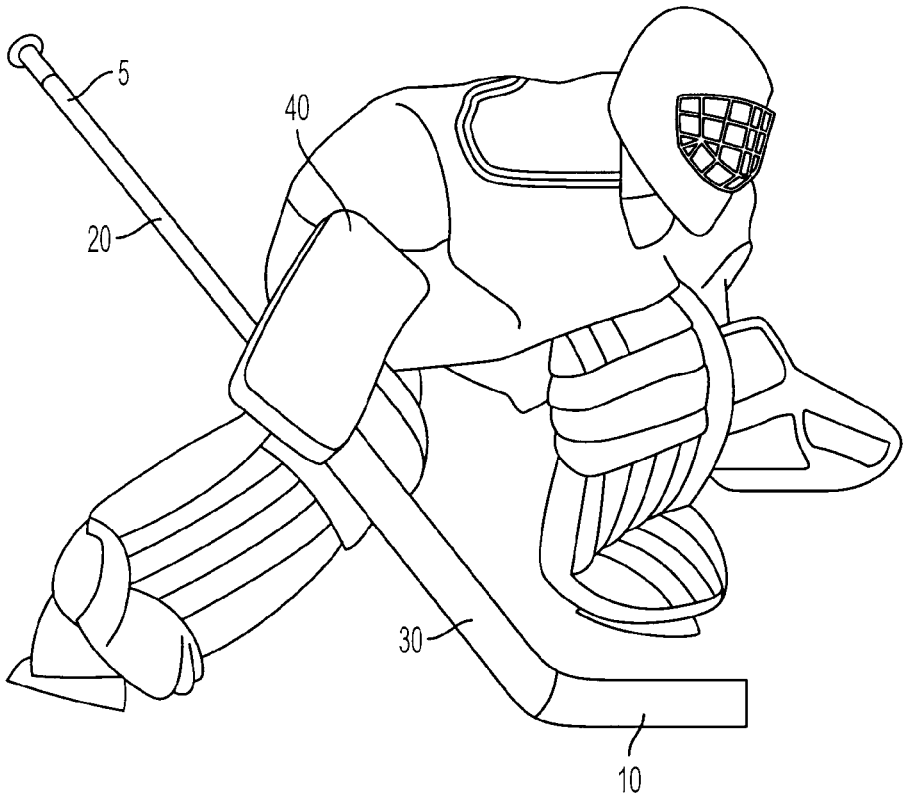
FIG. 1A is a diagram of a hockey goalie holding his hockey stick.
Figure 1B:
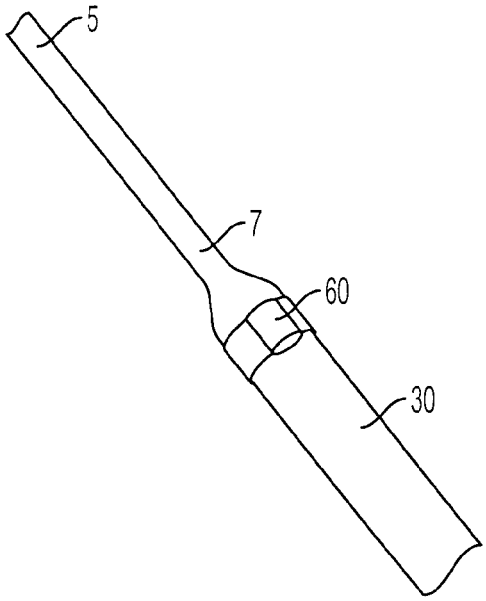
FIG. 1B is a close-up diagram of the stick/paddle interface.
Figure 2:
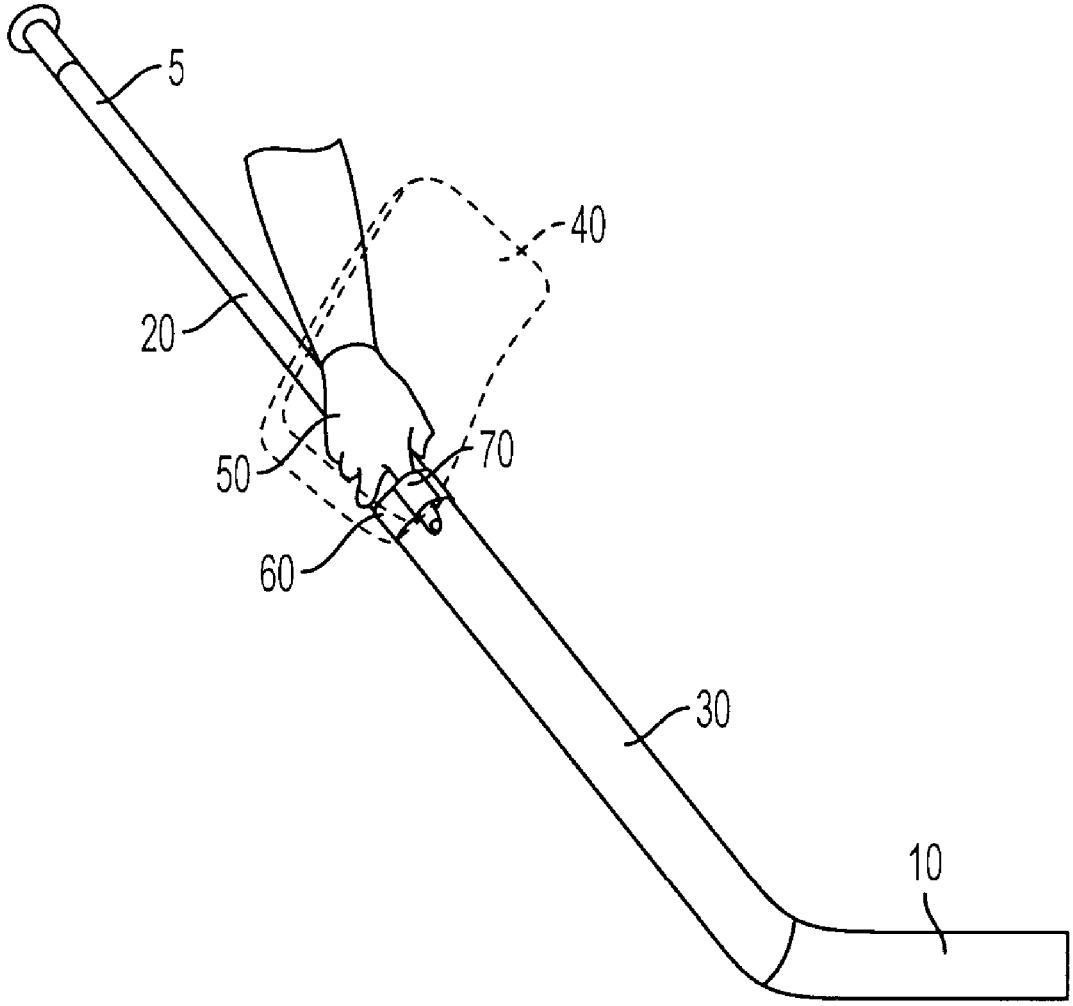
FIG. 2 is a diagram of the hand placement of the hockey goalie on his hockey stick.

The preferred embodiments of the present invention will now be described with respect to the Figures. FIG. 1A illustrates a hockey goalie in his equipment. The goalie's blocker glove 40 is on the hand of the goalie that holds the stick 5. The blade 10 of the stick 5 is wide and extends up the shaft 20 of the stick 5 to form the paddle 30. The goalie holds the stick 5 just above the paddle 30 in the region as shown in FIG. 2. The placement of the hand 50 and index finger 70 is shown under the goalie's blocker glove 40 in dotted lines in FIG. 2. FIGS. 1B and 2 each show the training device 60 of the present invention on the paddle 30. The placement of the goalie's hand 50 and index finger 70 are shown with the training device 60 encompassing the index finger 70.

Figure 3A:
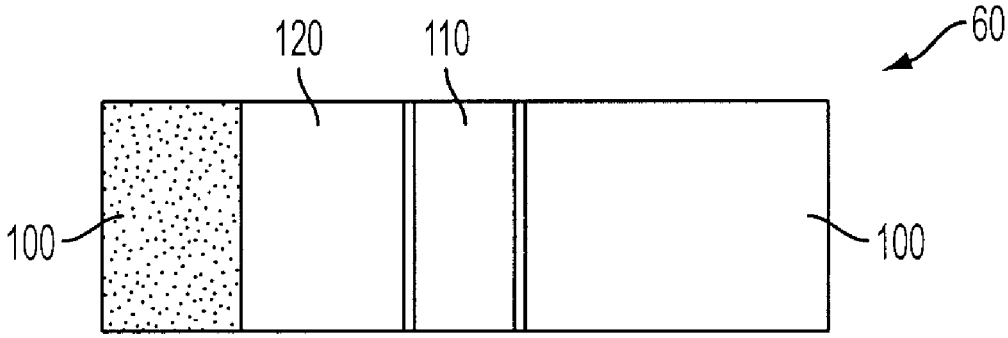
FIGS. 3A and 3B illustrate a first embodiment of the present invention.
Figure 3B:
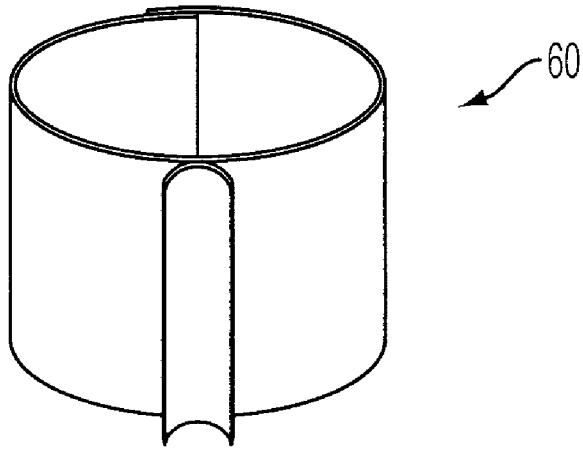

FIGS. 3A through 3E show various embodiments of the training device 60. FIGS. 3A and 3B show the preferred embodiment of the training device 60 with the strap as a rectangular component 120 with VELCRO connectors 100 and an open finger channel 110. The rectangular component 120 is placed on the paddle 30 of the hockey stick 5 and wrapped around it so that one side of the VELCRO connector 100 overlaps the other side to cause them to become connected as known in the art. The size of the rectangular component 120 and the adjustability of the VELCRO connector 100 allows the training device 60 to fit the paddle 30 snugly. The open finger channel 110 is attached to the rectangular component 120 so that it is positioned on the flat part of the paddle 30 while the VELCRO connector 100 is positioned on the opposite flat side of the paddle 30. The finger channel 110 is deep enough so that the index finger 70 will not easily move within the finger channel. The open finger channel 110 may be the width of the rectangular component 120 or may be smaller or larger. The open finger channel 110 and the VELCRO connectors 100 may be attached to the rectangular component 120 in a number of different ways including being sewn or glued. The rectangular component 120 is made from a sturdy flexible material. The finger channel 110 may be made from a sturdy plastic or rubber material and cups the goalie's index finger 70, which will be covered by the glove part of the blocker glove 40. Optionally, the finger channel 110 may be pivotally connected to the rectangular component 120 (e.g. by a loosely fitting rivet) to enable the finger to pivot slightly with respect to the paddle for maximum comfort. This also allows easy use by either a right-handed or left-handed goalie.

Figure 3C:
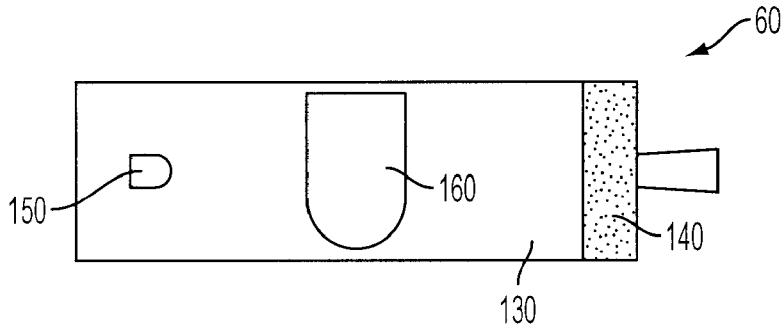
FIGS. 3C and 3D illustrate a second embodiment of the present invention.
Figure 3D:
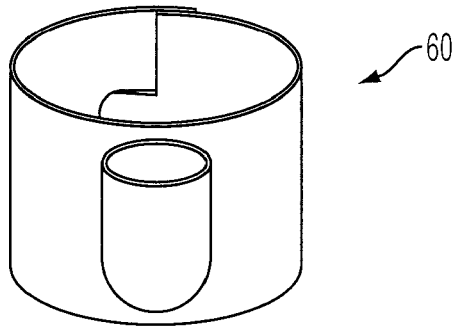

FIGS. 3C and 3D show a second embodiment of the training device 60 with the strap as a rectangular component 130 and a VELCRO connector 140 on one side of the rectangular component 130 and a loop 150 on the other side of the rectangular component 130. The VELCRO connector 140 is threaded through the loop 150 and folded back onto itself as known in the art. This adjustable connection allows the training device 60 to be snuggly fitted around the paddle 30. In this embodiment the finger channel 160 is shown as an elongated thimble shaped cup and the goalie's index finger 70 is placed inside the thimble shaped finger channel 160. The thimble shaped finger channel 160 loosely holds the index finger 70 so that the goalie can easily withdraw the index finger 70 when he needs to move his hand to the end of the stick 5 for a poke check, but the thimble shaped finger channel 160 does not allow the index finger 70 to slide around on the paddle 30. The materials and relative sizes of the components are the same as those described above.

Figure 3E:
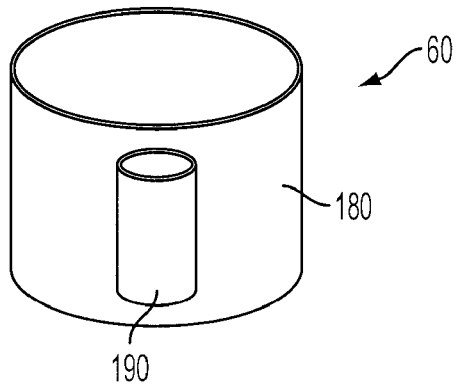
FIG. 3E illustrates a third embodiment of the present invention.

FIG. 3E shows a third embodiment of the training device 60 with the strap as a flexible tube 180 with a tube shaped finger channel 190. The flexible tube 180 may be made from a stretch material resembling a thick rubber band, and can be stretched and pulled over the paddle 30. The flexible tube 180 retracts tightly around the paddle 30 to hold the training device 60 in place. The tube shaped finger channel 190 is attached to the flexible tube 180 as above and holds the index finger 70 also as above.

It will be apparent to those skilled in the art that modifications to the specific embodiment described herein may be made while still being within the spirit and scope of the present invention. For example, the components of the different embodiments described above may be interchanged. The tube shaped finger channel 190 of FIG. 3E may be attached to the rectangular component 120 of FIG. 3C or the open finger channel 110 of FIG. 3A may be attached to the flexible tube 180 of FIG. 3E. Also, the VELCRO connectors 100 and 140 may be a different type of connector such as a buckle, a tie, or a hook and eye. The materials used to make the training device 60 may be different and the connection between the finger channel 110, 160, or 190 and the rectangle component 120, or 130, or the flexible tube 180, may be different and may include a more intricate connection containing a riser. Lastly the finger channel 110, 160, and 190 may be connected to the rectangle component 120, or 130, or the flexible tube 180 at an angle that is different than the perpendicular angle shown.

What is claimed is:

1. A training device in combination with a goalie hockey stick wherein said training device comprising:

a. a strap adapted to be fitted around the top of a paddle of a goalie hockey stick, and b. a finger channel affixed to said strap and positioned for removably holding an index finger such that said index finger is substantially pointed down the paddle of the goalie hockey stick when a user is holding the goalie hockey stick.

2. The training device of claim 1 wherein said finger channel is an open-ended sleeve.

3. The training device of claim 1 wherein the finger channel is pivotally attached to the strap.

* * * * *